US005679034A

United States Patent [19]

Hanazaki et al.

[11] Patent Number: 5,679,034

[45] Date of Patent: Oct. 21, 1997

[54] CONSTRUCTION OF RETAINING RESILIENT CONTACT PIECE IN FEMALE ELECTRICAL CONNECTION MEMBER

[75] Inventors: Hisashi Hanazaki; Mitsuharu Nakamura, both of Shizuoka, Japan

[73] Assignee: Yazaki Corporation, Tokyo, Japan

[21] Appl. No.: 674,968

[22] Filed: Jul. 3, 1996

Related U.S. Application Data

[63] Continuation of Ser. No. 489,953, Jun. 13, 1995, abandoned.

[30] Foreign Application Priority Data

Jun. 17, 1994 [JP] Japan ..... 6-135353

[51] Int. Cl.[6] ..... H01R 13/187

[52] U.S. Cl. ..... 439/845; 439/852

[58] Field of Search ..... 439/843, 845, 439/846, 849, 850

[56] References Cited

U.S. PATENT DOCUMENTS

| | | | |
|---|---|---|---|
| 5,269,712 | 12/1993 | Denlinger et al. | 439/845 |
| 5,340,338 | 8/1994 | Sai et al. | 439/845 |
| 5,433,629 | 7/1995 | Yagi et al. | 439/845 |

FOREIGN PATENT DOCUMENTS

| | | | |
|---|---|---|---|
| 57-140181 | 9/1982 | Japan | H01R 13/187 |

OTHER PUBLICATIONS

"About Relationship Between Width Of Material And Working–Crack in In Bending Work"—Mitsubishi Shindoh Co., Ltd.—Jun. 17, 1991.

*Primary Examiner*—Neil Abrams
*Assistant Examiner*—T. C. Patel
*Attorney, Agent, or Firm*—Sughrue, Mion, Zinn, Macpeak & Seas, PLLC

[57] ABSTRACT

A plurality of retaining piece portions are formed at an edge of a tubular body of a female electrical connection member, and the retaining piece portions are bent to clampingly retain plural portions in one end of a resilient contact piece. As a result, the retaining piece portions can be bent easily, and a crack is prevented from developing at the bent portion. And besides, since the resilient contact piece is fixed by the retaining piece portions at the plurality of portions thereof spaced from one another, stresses, concentrating on the fixed portions of the resilient contact piece, are distributed on the fixed portions, so that permanent set of the resilient contact piece due to deterioration of its resiliency can be prevented.

4 Claims, 3 Drawing Sheets

CONSTRUCTION OF RETAINING RESILIENT CONTACT PIECE IN FEMALE ELECTRICAL CONNECTION MEMBER

This is a Continuation of application Ser. No. 08/489,953 filed Jun. 13, 1995 now abandoned.

BACKGROUND OF THE INVENTION

1. Field of The Invention

This invention relates to a construction of retaining a resilient contact piece in a female electrical connection member such as a female terminal used for connecting an electrical circuit.

2. Background

A conventional female terminal F shown in FIGS. 5 and 6 is disclosed in Japanese Utility Model Unexamined Publication No. 57-140181.

The female terminal F includes a hollow body a for receiving a male terminal, and a resilient piece b provided within this tubular body, the resilient piece being curved into a mountain-like contour. The male terminal is resiliently held between the hollow body a and the resilient piece One end of the resilient piece b is fixedly clamped by a retaining portion c at a front end of the hollow body a. This retaining portion c is formed by bending a front end portion of a base plate of the hollow body a through an angle of about 180°.

Since the retaining portion c is thus formed by bending the base plate of the hollow body c through about 180°, a crack is liable to develop at the bent portion, so that this retaining portion is damaged, and the resulting product becomes defective. The resilient piece b, clamped at one end by the retaining portion c, is fixed by this retaining portion c, and therefore stresses concentrate on this fixed portion, and the resilient piece is deteriorated (that is, subjected to permanent set in fatigue) in a relatively short time, which results in a problem that the force for resiliently holding the male terminal is reduced, so that an incomplete contact may occur.

SUMMARY OF THE INVENTION

The present invention has been made in view of the above problem, and an object of the invention is to provide a construction of retaining a resilient contact piece in a female electrical connection member, in which a retaining portion fixing the resilient contact piece can be easily bent without any crack, and permanent set of the resilient contact piece due to fatigue can be prevented.

The above object of the invention has been achieved by a construction of retaining a resilient contact piece in a female electrical connection member wherein the resilient contact piece is mounted within a hollow body of an electrical contact portion; and a male terminal received in the hollow body is held between the resilient contact piece and the tubular body; CHARACTERIZED in that a plurality of retaining piece portions are formed on that portion of the hollow body at which one end of the resilient contact piece is disposed; and the retaining piece portions are bent to clampingly retain the one end of the resilient contact piece at a plurality of portions of the resilient contact piece.

In the present invention, since the retaining piece portions, clamping the resilient contact piece, are provided in spaced relation to one another, the retaining piece portions can be bent easily, and a crack is prevented from developing at the bent portion. And besides, since the resilient contact piece is fixed by the retaining piece portions at the plurality of portions thereof spaced from one another, stresses, concentrating on the fixed portions of the resilient contact piece, are distributed on the fixed portions, so that permanent set of the resilient contact piece due to deterioration of its resiliency can be prevented. Therefore, by using the retaining construction of the invention, the durability and reliability of the electrical connection member such as a female terminal are markedly enhanced.

DETAILED DESCRIPTION OF THE PREFERRED EMBODIMENTS

Figure 1:
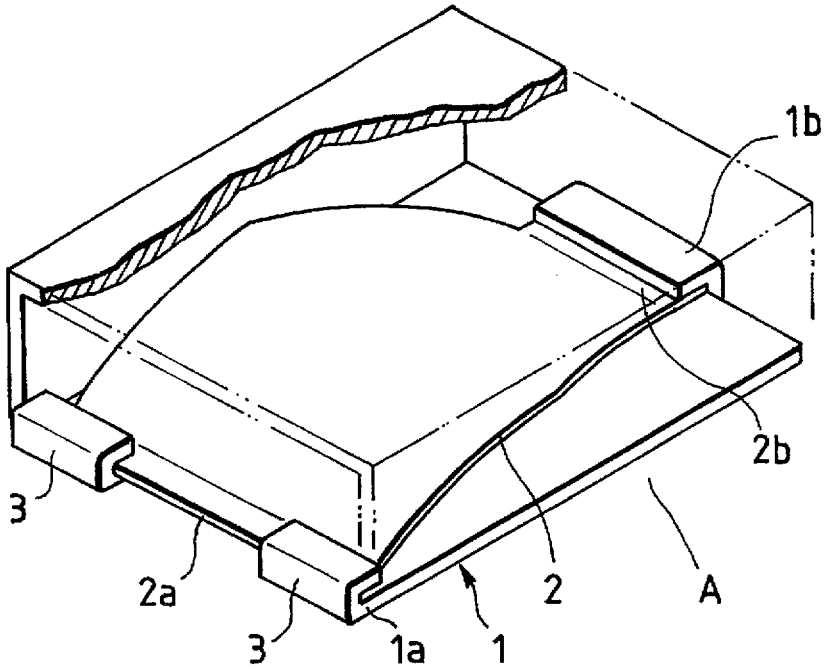
FIG. 1 is a partly-broken, perspective view of a female electrical connection member of the invention.
Figure 2:
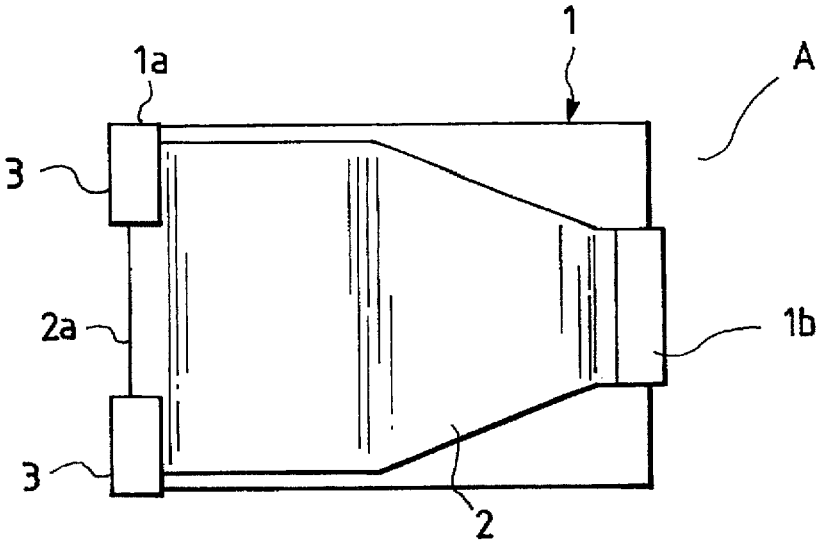
FIG. 2 is a plan view of the female electrical connection member of FIG. 1.

FIG. 1 is a perspective view of a preferred embodiment of a female electrical connection member A of the invention having a resilient contact piece-retaining construction. FIG. 2 is a plan view showing a retaining portion.

The female electrical connection member A includes a hollow body 1 formed by bending an electrically-conductive plate, and the resilient contact piece 2 of an arch-shape. A male terminal (not shown), received in the body 1, is held between the body 1 and the resilient contact piece 2, thereby making an electrical connection between the female electrical connection member A and the male terminal.

One end 2*a* of the resilient contact piece 2 is fixedly secured to the hollow body 1 by two retaining piece portions 3 and 3 which first project from an open end edge la of the hollow body 1, and then are bent or folded back about 180° to be pressed against the one end 2*a* of the resilient contact piece 2. The other end 2*b* is received in and retained by a retaining pawl 1*b* formed on the hollow body 1.

A brass sheet having a thickness t of 0.32 mm is used as the electrically-conductive plate for forming the hollow body 1, and the retaining piece portion 3 has a width w of 2.5 mm. Therefore, this satisfies the requirement of the following formula which represents a critical value for the development of a crack in the bending of the brass sheet.

$$w/t<8$$

Therefore, the bending can be easily effected, and any cracks are not produced.

Figure 3:
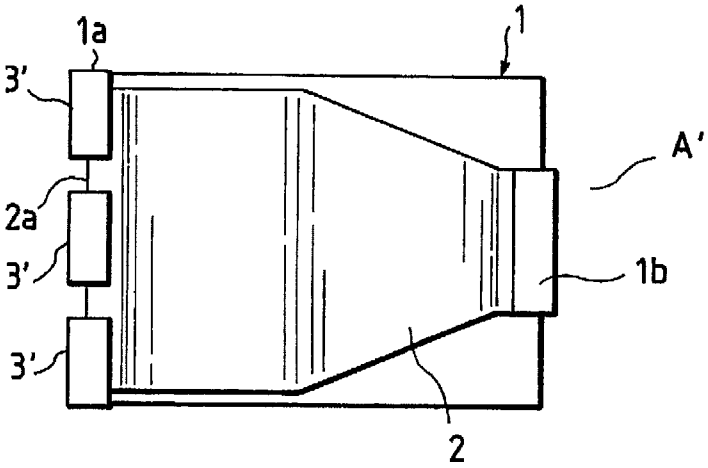
FIG. 3 is a plan view of a modified female electrical connection member of the invention.

FIG. 3 shows a female electrical connection member A' in which three retaining piece portions 3', formed on an edge 1*a* of a hollow body 1, retain the resilient contact piece 2.

The retaining piece portion 3' is formed by a brass sheet having a thickness of 0.32 mm, and has a width w of 2.5 mm, as described above for the retaining piece portion 3.

In the female electrical contact portion A', the resilient contact piece 2 is retained by the three retaining piece portions 3', and therefore advantageously, the resilient contact piece 2 is retained more positively.

Figure 4:
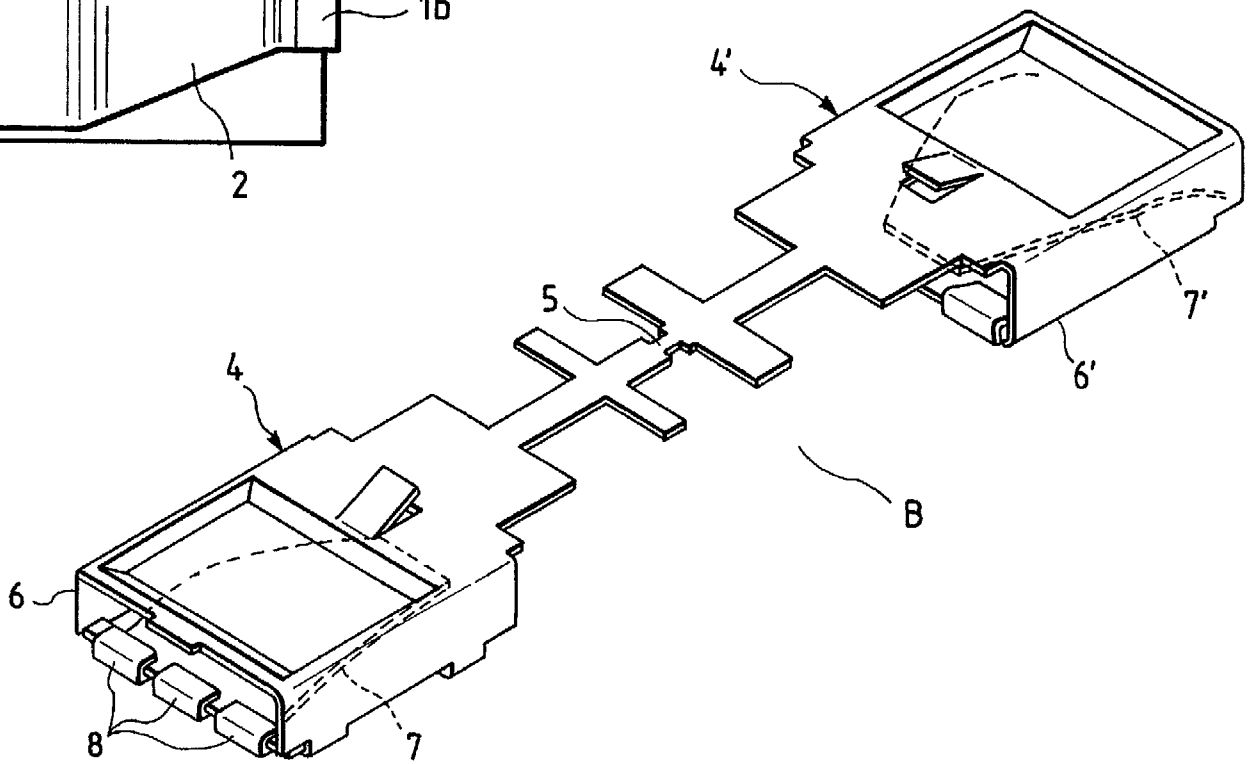
FIG. 4 is a perspective view of a fuse terminal embodied by the invention.
Figure 5:
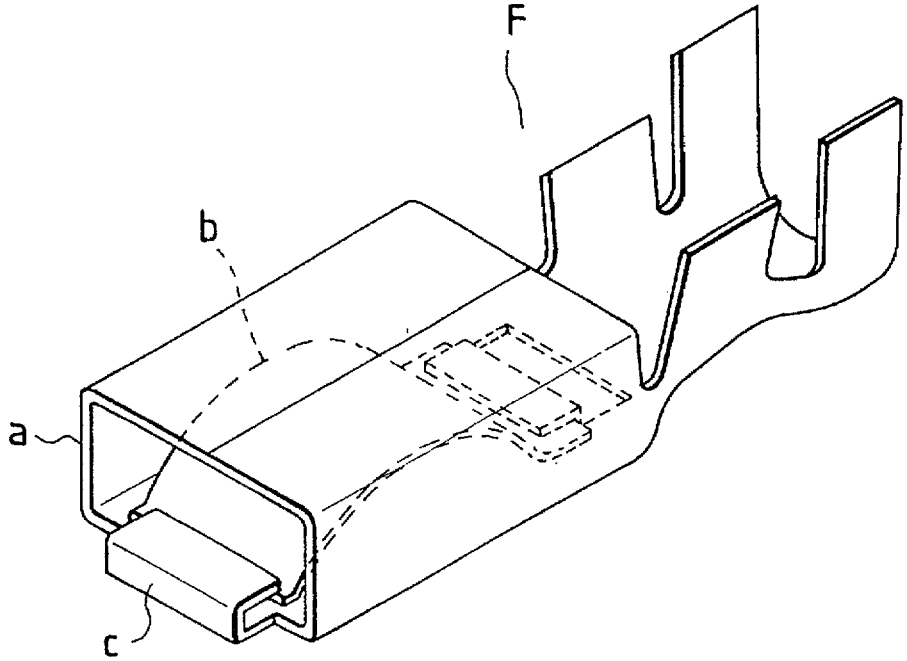
FIG. 5 PRIOR ART
FIG. 5 is a perspective view of a conventional female terminal.
Figure 6:
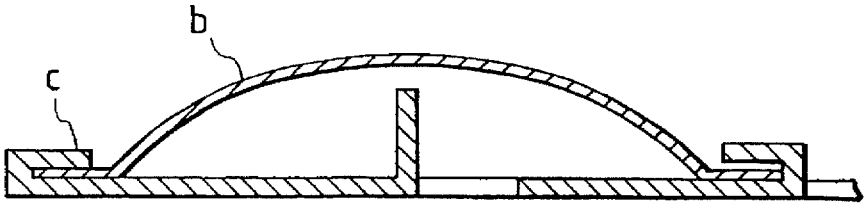
FIG. 6 PRIOR ART
FIG. 6 is a view showing a resilient piece and a retaining portion in the terminal of FIG. 5.

FIG. 4 is a perspective view of another embodiment of the invention, that is, a fuse terminal B.

The fuse terminal B includes a pair of electrical contact portions 4 and 4', and a fuse 5 connected between the two electrical contact portions. Each of the electrical contact portions 4 and 4' has the same construction as that of a female electrical connection member, and the fuse terminal is bent at the fuse 5, and mating tabs (not shown) are inserted into and connected to the electrical contact portions 4 and 4', respectively.

More specifically, the electrical contact portion 4, 4' includes a tubular body 6, 6' formed of an electrically-conductive plate, and a resilient contact piece 7, 7' mounted within this tubular body. The resilient contact piece 7 is clamped and retained by three retaining piece portions 8 formed integrally with the hollow body 6. The resilient contact piece 7' is retained in the same manner, and therefore explanation thereof is omitted here.

In the fuse terminal B, the resilient contact piece 7 is fixed by the three narrow retaining piece portions 8 spaced from one another, as in the female electrical connection member A'. Therefore, the retaining piece portions 8 can be easily bent, and any crack is not produced, and permanent set of the resilient contact piece 7 due to fatigue is prevented.

In the present invention, since the retaining piece portions, clamping the resilient contact piece, are provided in spaced relation to one another, the retaining piece portions can be bent easily, and a crack is prevented from developing at the bent portion. And besides, stresses, concentrating on the fixed portions of the resilient contact piece, are distributed on the fixed portions, so that permanent set of the resilient contact piece due to fatigue can be prevented. Therefore, by using the retaining construction of the invention, there is achieved an advantage that the durability and reliability of the electrical connection member such as a female terminal are markedly enhanced.

What is claimed is:

1. A female electrical connection member, comprising:

an electrically conductive plate including an electrical contact portion for receiving another terminal, said electrical contact portion including a hollow body;

a resilient contact piece provided within said hollow body;

retaining piece portions formed to fixedly secure plural portions of one end of said resilient contact piece to said hollow body, at an open end edge of said hollow body, respectively, said retaining piece portions each including a U-shaped member extending from said conductive plate and defining a recess in which an associated one of said plural portions is received and retained, each said U-shaped member being formed by bending an extension portion of said conductive plate; and a retaining pawl for retaining the other end of said resilient contact piece to said tubular body.

2. The female electrical connection member of claim 1, wherein said retaining piece portions are not less than two pieces.

3. The female electrical connection member of claim 1, wherein a relationship of a thickness (t) of said electrically conductive plate forming said hollow body and the width (w) of each said retaining piece portions satisfies a formula:

$$w/t<8.$$

4. A female electrical connection member as recited in claim 1, comprising a pair of electrical contact portions (4, 4') and a fuse (5) connected between said pair of electrical contact portions.

* * * * *